United States Patent [19]

Watson, Jr.

[11] 3,962,648

[45] June 8, 1976

[54] FUNCTION GENERATOR

[75] Inventor: Charles A. Watson, Jr., Bremerhaven, Germany

[73] Assignee: E-Systems, Inc., Dallas, Tex.

[22] Filed: Jan. 20, 1975

[21] Appl. No.: 542,200

[52] U.S. Cl. ..... 328/142; 307/229; 330/86

[51] Int. Cl.[2] ..... G06G 7/12

[58] Field of Search ..... 328/142, 144, 145; 330/86; 307/229; 235/197

[56] References Cited

UNITED STATES PATENTS

| | | | |
|---|---|---|---|
| 3,185,827 | 5/1965 | Herndon | 235/197 |
| 3,408,582 | 10/1968 | Britton | 307/229 X |
| 3,739,196 | 6/1973 | Tavis | 328/145 X |

*Primary Examiner*—James B. Mullins
*Attorney, Agent, or Firm*—Robert V. Wilder

[57] ABSTRACT

A segmented voltage function is generated at the output of a primary differential amplifier having an input voltage connected to the noninverting terminal. As the input voltage increases at the noninverting amplifier input, the output increases with the same slope until a voltage as sensed at the inverting input of the amplifier equals a first breakpoint. The inverting input to the primary differential amplifier connects to a feedback circuit that also includes a plurality of secondary differential comparator amplifiers coupled to a voltage ladder network. Each of the secondary differential amplifiers has a noninverting input connected to a separate voltage on the ladder network. The inverting input of each of the secondary differential amplifiers is connected to a feedback loop. At the first breakpoint one of the secondary differential comparator amplifiers switches into a conduction mode through a gain resistor connected to the output of the secondary amplifier and the inverting input of the primary differential amplifier. This clamps the gain resistor to the first breakpoint voltage established by the ladder network. All other comparator amplifiers in the feedback loop are operating in a comparator "off" mode and will remain in this mode until the output of the primary differential amplifier equals the breakpoint voltages established by the noninverting input terminal of the comparator amplifiers. As each of the comparator amplifiers switches into a conduction mode, the associated gain resistor is clamped to the breakpoint voltage and the gain of the primary differential amplifier is progressively increased to a desired level.

8 Claims, 3 Drawing Figures

FUNCTION GENERATOR

This invention relates to a function generator and more particularly to a function generator having a segmented output of approximately straight line section.

Function generators are widely used in control systems and there are many presently available generators wherein the output function may be changed either manually or automatically by a change of the ratio of the output potential with a change of input potential. Several different types of function generators employing straight line segments have been implemented. In one type, either Zener diodes or biased diodes are used in circuits to inhibit current until one of a plurality of corresponding threshold voltages is exceeded. By judicious choice of these threshold voltages and necessary scaling factors, curves without substantial inflection can be approximated. Inaccuracies, however, have plagued users of these prior art function generators. This is for the reason that the diode resistance changes due to changes in temperature and further the forward voltage drop across such diodes is nonlinear with current.

In addition to the segmented straight line approximation technique, nonlinear function generators have also been constructed that use the continuous nonlinear transfer characteristics of an active device. An example of these generators is the use of a logarithmic V-I (where V is the voltage and I is current) relationship of a log diode. With proper bias, the current of this diode is approximated by a logarithmic relationship. A diode of this type is frequently used in conjunction with an operational amplifier to give the log or antilog transfer characteristics desired. This technique is also susceptible to inaccuracy due to temperature variation because the nonlinear element frequently varies with temperature causing slope and breakpoint variation.

The function generator of the present invention provides a plurality of discrete ratios of incremental input to incremental output automatically selected by a changing of the output potential at successively different levels. A feature of the present invention is to provide a reproducible segmented output voltage function in response to a given input signal. Another feature of the present invention is to provide a function generator having improved temperature sensitivity significantly greater than previously achievable. Still another feature of the present invention is to provide a segmented output voltage function from a generator having improved function accuracy to a desired mathematical expression.

In accordance with one embodiment of the invention, a function generator comprises a primary differential amplifier having first and second input terminals and a feedback loop from an output terminal to the second of the input terminals. A plurality of gain resistors are interconnected to a summing junction as a part of the second input terminal. A voltage ladder network provides control voltages in number equal to the plurality of gain resistors and control means interconnect the control voltages of the ladder network to the plurality of gain resistors individually such that the gain of the differential amplifier varies by selectively connecting the gain resistors to the control voltages.

In accordance with a preferred form of the invention, the control means includes a plurality of secondary differential amplifiers having individual input terminals responsive to one of the control voltages and an output terminal individually connected to one of the plurality of gain resistors. As the output voltage of the primary differential amplifier becomes equal to a control voltage, one of the secondary differential amplifiers conducts to clamp the respective gain resistor to the control voltage thereby varying the gain of the differential amplifier.

For a more detailed understanding of the invention, reference is to be had to the following description taken in conjunction with the accompanying drawings.

Referring to the drawings.

Figure 1:
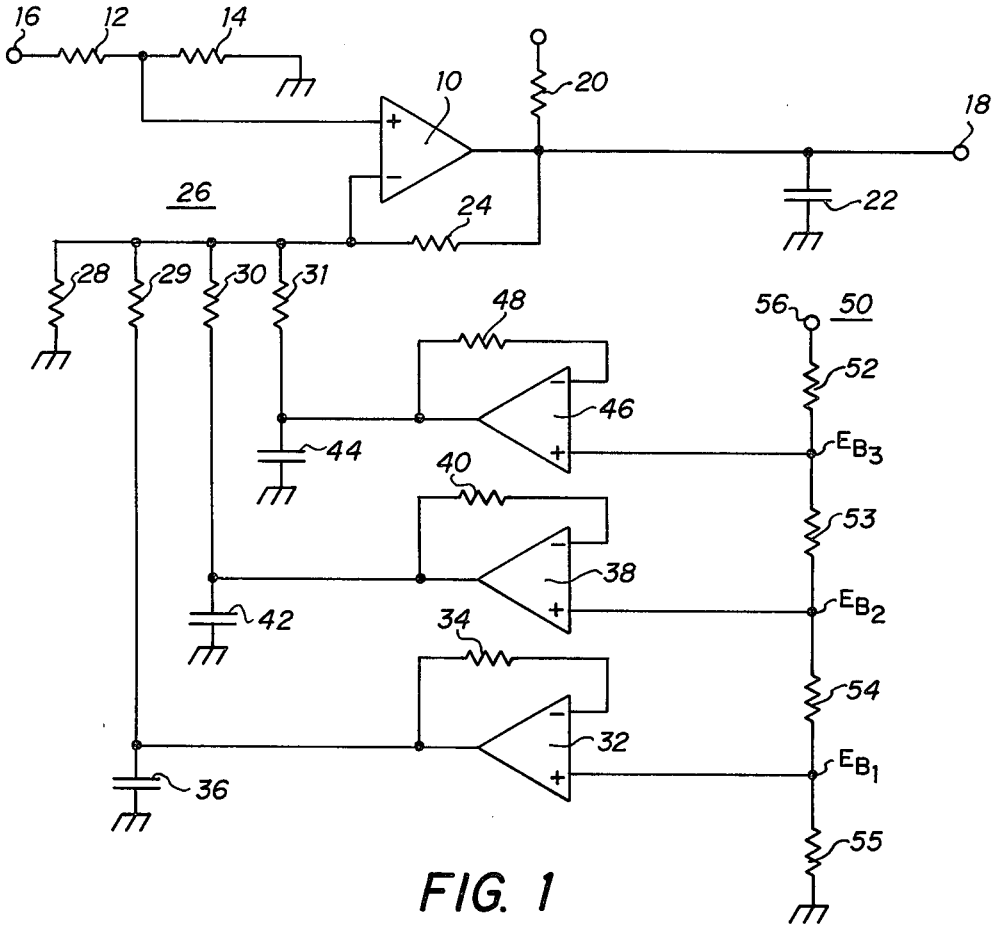
FIG. 1 is a schematic block diagram of a function generator in accordance with the present invention.

Referring to FIG. 1, a primary differential amplifier 10 has a noninverting input terminal connected to a voltage divider input network comprising resistors 12 and 14. An input terminal 16 is tied to one end of the resistor 12. An output voltage from the differential amplifier 10 is generated at an output terminal 18 and varies in accordance with the input voltage applied to the terminal 16 and a feedback voltage applied to the inverting input of the amplifier 10. Also connected to the output of the amplifier 10 is a supply resistor 20 and a filter capacitor 22.

A feedback circuit for the amplifier 10 includes a feedback resistor 24 connected to the output terminal of the amplifier and the inverting input terminal. Also forming a part of the circuit for controlling the voltage to the inverting input terminal of the amplifier 10 is a gain control circuit 26 comprising gain resistors 28–31 in parallel and connected to the inverting input terminal. The gain resistor 28 connects to ground and in conjunction with the feedback resistor 24 establishes the first gain level of the amplifier 10. Each of the other gain resistors 29–31 is connected to a secondary differential comparator amplifier.

Specifically, the gain resistor 29 is connected to the output of a secondary differential comparator amplifier 32 having a noninverting input tied to a voltage ladder network (to be explained) and an inverting input terminal connected to a feedback loop including a resistor 34. Coupled from the output of the amplifier 32 to ground is a capacitor 36. Next, considering the gain resistor 30, it is connected to the output of a secondary differential comparator amplifier 38 also having a noninverting input terminal connected to a voltage ladder network. The inverting input terminal of the amplifier 38 is connected to a feedback circuit including a resistor 40. The output terminal of the amplifier 38 is bypassed by capacitor 42 to ground. The gain resistor 31 is coupled to a capacitor 44 and also to the output terminal of a secondary differential comparator amplifier 46 having a noninverting input terminal connected to the voltage ladder network. The inverting input terminal of the amplifier 46 is connected to a feedback path comprising a resistor 48.

Each of the secondary differential comparator amplifiers 32, 38 and 46 connects to a control voltage ladder 50 consisting of resistors 52–55 in series from a supply voltage applied to a terminal 56 and connected to ground. At the interconnection of any two resistors in the voltage ladder 50, a voltage is established that controls a breakpoint in the output voltage function at the output terminal 18.

Figure 2:
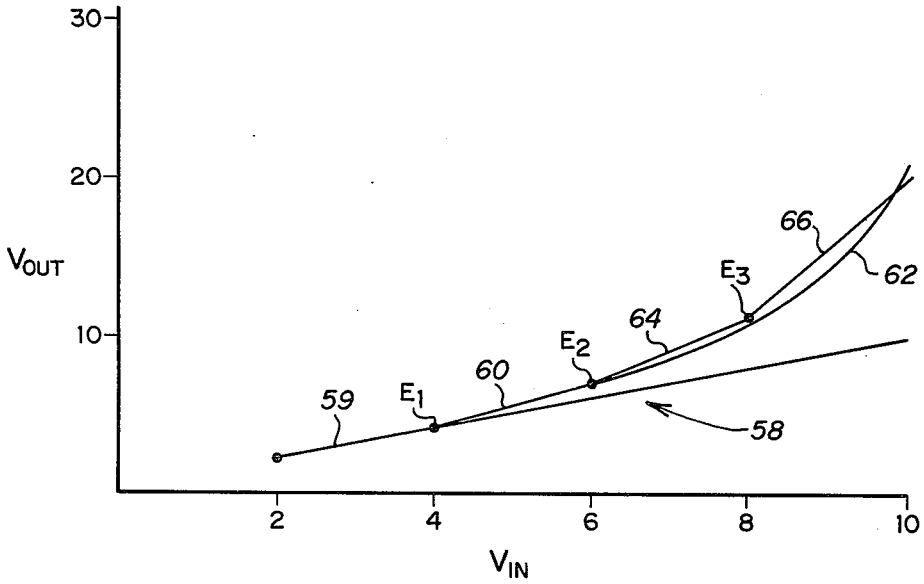
FIG. 2 is a plot of voltage output versus voltage input showing the segmented voltage function.

Referring to FIG. 2, there is shown a curve of output voltage at the terminal 18 versus input voltage at the terminal 16. As the input voltage increases from two volts the output of the differential amplifier 10 increases with the slope as given by the curve 58. That is, the output varies linearly with an increase in input. The gain of the amplifier 10 is now controlled by the feedback resistor 24 and the gain resistor 28 in addition to the resistors 12 and 14 in accordance with the expression:

$$G_1 = \frac{R14}{R12+R14} \left[ \frac{R24}{R28} + 1 \right] \quad (1)$$

The output voltage continues to increase along the curve 58 (segment 59) until the voltage at the inverting input terminal equals the first control voltage (breakpoint voltage) as established at the junction of the resistors 54 and 55 and identified as $E_{B_1}$. At this point, the secondary differential comparator amplifier 32 switches into a conduction mode and operates in the linear region to clamp the gain resistor 29 to a voltage established by the junction of resistors 54 and 55.

As the input voltage increases from 4 volts (the voltage levels are by way of example only as these are determined by the circuit values) the output of the amplifier 10 at the terminal 18 now varies along the curve 60, that is, the second segment of a curve to synthesize the function as illustrated by the curve 62. When the output varies in accordance with the segment 60 only the differential comparator amplifier 32 is conducting with the amplifiers 38 and 46 in a comparator "off" mode. During this mode of operation of the amplifier 32, the gain of the amplifier 10 is established by the resistors 12, 14, 24 and 28, as before, in addition to the gain resistor 29. The gain varies in accordance with the expression:

$$G_2 = \frac{R14}{R12+R14} \left[ \frac{R24}{R28 \cdot R29} + 1 \right] \quad (2)$$

With the amplifier 32 conducting, the gain of the amplifier 10 is set by equation (2) and continues until an input voltage applied to the terminal 16 reaches the 6 volt level. As the input voltage increases from 6 volts, the output of the amplifier 10 at the terminal 18 now varies along the curve segment 64. The amplifier gain is established for this segment of the output curve when the voltage at the inverting input terminal of the amplifier 10 equals the control voltage as established between the resistors 53 and 54 and identified as a control voltage $E_{B_2}$. At this point, both the comparator amplifiers 32 and 38 are in a comparator "on" mode and the gain resistors 29 and 30 are clamped to respective control voltages, namely, at voltage $E_{B_1}$ and voltage $E_{B_2}$.

While the output of the amplifier 10 varies in accordance with the curve segment 64, the gain is established by the resistors 12, 14, 24, 28, 29 and 30. The gain of the amplifier 10 is now given by the expression:

$$G_3 = \frac{R14}{R12+R14} \left[ \frac{R24}{R28 \cdot R29 \cdot R30} + 1 \right] \quad (3)$$

Finally, as the input voltage increases from eight volts, the output of the amplifier 10 at the terminal 18 varies along the curve segment 66. The input voltage appearing at the inverting input of the amplifier 10 now equals the voltage established by the junction of resistors 52 and 53 and the differential comparator amplifier 46 operates in the comparator "on" mode. This clamps the gain resistor 31 to the control voltage $E_{B_3}$. All three of the differential comparator amplifiers 32, 38 and 46 are now in a comparator "on" mode and the gain of the amplifier 10 is established by the resistors 12, 14, 24, and 28–31. The expression for the gain of the amplifier 10 is as follows:

$$G_4 = \frac{R14}{R12+R14} \left[ \frac{R24}{R28 \cdot R29 \cdot R30 \cdot R31} + 1 \right] \quad (4)$$

The approximation of the desired curve 66 is composed of line segments 59, 60, 64 and 66 defined by breakpoints $E_1$, $E_2$ and $E_3$ as related to the control voltages $E_{B_1}$, $E_{B_2}$, and $E_{B_3}$. The number of line segments required to represent an ordinary function for normal accuracy is surprisingly small. For example, for the equation $Y = X^2$, a four line segment synthesized curve over a given range of interest provides an accuracy of 0.78%. This means that the maximum error between the synthesized curve and the desired curve is 0.78% of the maximum value of $Y(= X^2)$.

Should greater accuracy be required, more line segments can be used in the synthesized curve. For the square law function under consideration, for twice as many line segments the error is reduced to one-quarter its previous value. Thus, for sixteen line segments instead of four, the error is reduced to $0.78 \times (4/16)^2 = 0.05\%$.

The circuit of FIG. 1 is easily expandable to produce a sixteen line segment synthesized curve. This expansion requires additional gain resistors in parallel with the resistors 28–31, one additional gain resistor for each additional line segment. In addition, each of the gain resistors is controlled by a secondary differential comparator amplifier having one input connected to a control voltage. Thus, the expansion also requires a voltage ladder having control voltages equal in number to the number of gain resistors, less one.

Figure 3:
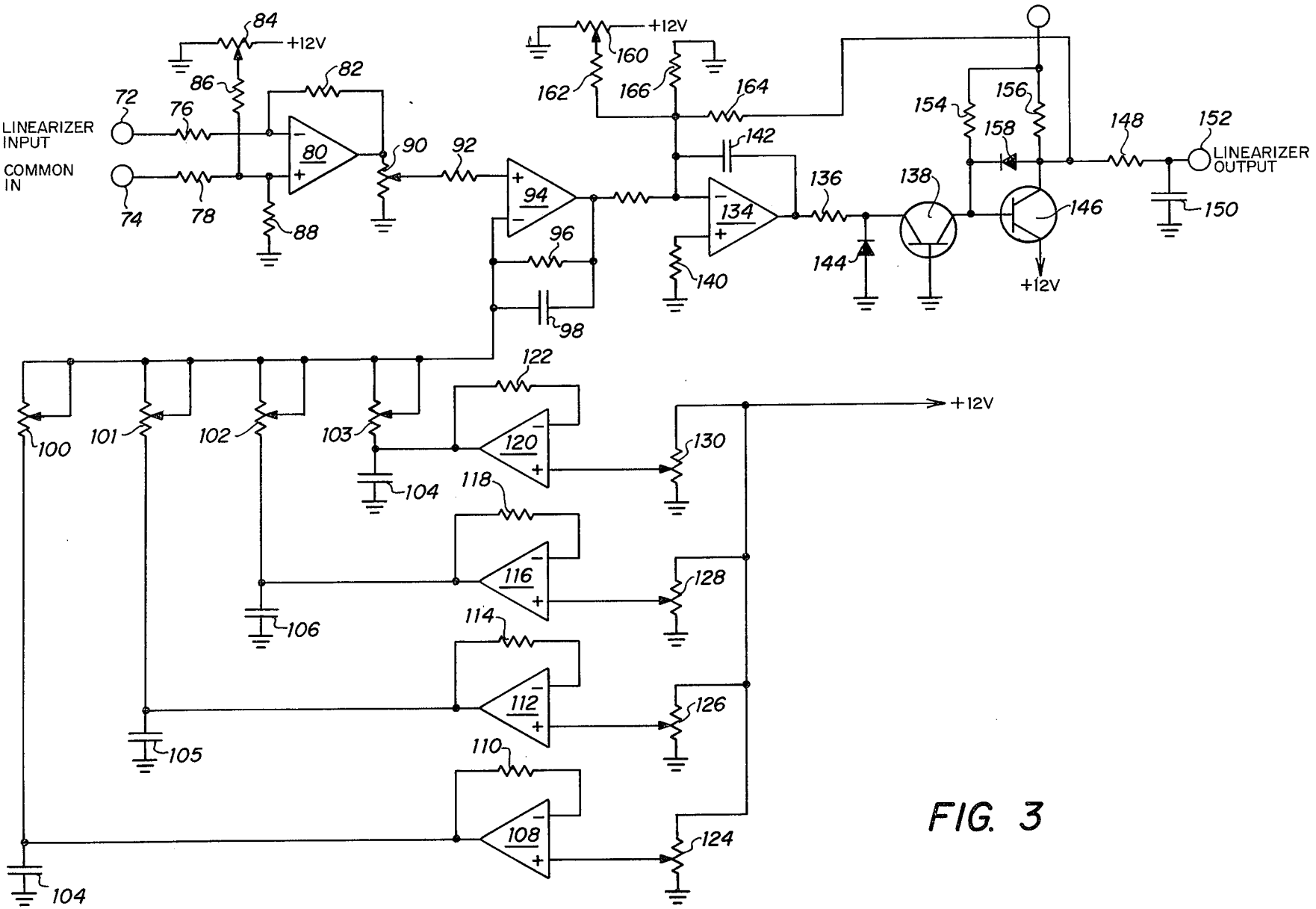
FIG. 3 is a detailed schematic of a preferred embodiment of the present invention to provide a five segment output voltage function from a primary differential amplifier.

Referring to FIG. 3, there is shown a preferred embodiment of a function generator of the present invention wherein an input voltage is differentially connected to input terminals 72 and 74 to common mode suppress any noise pickup on input lines. This input voltage at the terminals 72 and 74 is coupled through resistors 76 and 78 to input terminals of a scaling amplifier 80 having a feedback path consisting of a resistor 82. An offset voltage for the input connected to the terminals 72 and 74 is provided by a potentiometer 84 and a divider network including resistors 86 and 88.

An output voltage from the scaling amplifier 80 is applied across a gain potentiometer 90 having a wiper arm coupled through a resistor 92 to the noninverting input terminal of a linearizer amplifier 94. The linearizer amplifier 94 is the equivalent to the primary differential amplifier 10 of FIG. 1.

Associated with the amplifier 94 is a variable gain control network including a feedback circuit of a resistor 96 in parallel with a capacitor 98. The gain of the amplifier 94 is variably controlled by means of gain potentiometers 100–103. Each of these potentiometers is coupled to ground through a respective capacitor 104–107.

At the junction of the potentiometer 100 and the capacitor 104, there is connected the output of a secondary differential comparator amplifier 108 having a feedback loop comprising a resistor 110. Similarly, the junction of the potentiometer 101 and the capacitor 105 is tied to the output of a secondary differential comparator amplifier 112 having a feedback loop comprising a resistor 114. Connected to the junction of the potentiometer 102 and the capacitor 106 is a secondary differential comparator amplifier 116 having a feedback loop consisting of a resistor 118. A secondary differential comparator amplifier 120 has an output tied to the junction of the potentiometer 103 and the capacitor 107 and includes a feedback loop of resistor 122.

Each of the secondary differential comparator amplifiers 108 has a noninverting input terminal coupled to a control voltage potentiometer. The amplifier 108 is coupled to the wiper arm of a potentiometer 124 connected to the positive terminal of a DC supply. Also connected to the DC supply is a potentiometer 126 having a wiper arm coupled to the noninverting input of the amplifier 112. A potentiometer 128 is connected to the noninverting input of the amplifier 116 and a potentiometer 130 has a wiper arm connected to the noninverting input terminal of the amplifier 120.

When the potentiometers 124, 126, 128 and 130 are adjusted to the maximum positive voltage, the comparator amplifiers 108, 112, 116 and 120 are in a nonconducting mode and the amplifier 94 is operated in a linear mode. By adjusting the voltage at which the various comparator amplifiers 108, 112, 116 and 120 transfer into a conducting mode the potentiometers 100–103 are selectively shunted in parallel thereby changing the gain of the amplifier 94 as the voltage at the inverting input equals the voltage set at the potentiometers 124, 126, 128 and 130.

The initial gain of the amplifier 94 is set by the potentiometer 90 which is the equivalent of the resistors 12 and 14 of FIG. 1. When the voltage at the noninverting input of the amplifier 94 equals the voltage established by the setting of the potentiometer 124, the comparator amplifier 108 switches into a conducting mode to clamp the potentiometer 100 to the voltage at the potentiometer 124 thereby increasing the gain to a value established by the setting of the potentiometer 100. This second gain is maintained until the noninverting input terminal equals the voltage established by the setting of the potentiometer 126. At this time the comparator amplifier 112 switches into a conducting mode and the gain of the amplifier 94 is again increased to a value established by the setting of the potentiometer 101. The comparator amplifiers 116 and 120 operate in a similar manner as the comparator amplifiers 108 and 112 to incrementally increase the gain of the amplifier 94 as established by the potentiometers 102 and 103 at the breakpoints established by the potentiometers 128 and 130. Each setting of the potentiometers 124, 126, 128 and 130 establishes a separate breakpoint, and for the circuit of FIG. 3 four breakpoints are provided. The setting of the potentiometers 90 and 100–103 provides for five slopes of the output curve to establish a nonlinear function output for a linear input.

The nonlinear output voltage of the amplifier 94 is applied through a resistor 132 to a voltage range adjusting circuit including a differential amplifier 134 having an output connected through a resistor 136 to the emitter electrode of a transistor 138. The noninverting input of the amplifier 134 is coupled to ground through a resistor 140 and a feedback loop includes a capacitor 142. Also coupled to the emitter electrode of the transistor 138 is a shunt diode 144. The base electrode of the transistor 138 is grounded.

As output voltage from the transistor 138 at the collector electrode is applied to the base electrode of a transistor 146 having a collector electrode connected to a DC supply and an emitter electrode coupled to an output circuit including a resistor 148 and a capacitor 150 to produce a nonlinear function voltage output at a terminal 152. The biasing circuitry for the transistors 138 and 146 consists of resistors 154 and 156 and a diode 158.

The scaling of the voltage range circuitry is provided by a potentiometer 160 having a wiper arm in series with a resistor 162 connected to the inverting input terminal of the amplifier 134 and also to a resistor 164. The resistor 164 is part of a feedback loop from the emitter electrode of the transistor 146. Also as part of the scaling circuit is a resistor 166 connected to ground.

Functionally, the circuit of FIG. 3 is as described with reference to FIG. 1. As mentioned with regard to FIG. 1, additional line segments can be added. The circuit of FIG. 3 shows a five line segment function generator. The initial slope of the output function of the amplifier 94 is set when all the comparator amplifiers are in a nonconducting mode. The slope of the remaining four line segments of the function at the output of the amplifier 94 is controlled by the number of comparator amplifiers in a conducting mode.

In an experimental model of the circuit of FIG. 3, the values of the various components are as given in TABLE I below.

TABLE I

| | |
|---|---|
| Resistor 76 | 10K |
| Resistor 78 | 4.7K |
| Resistor 82 | 4.7K |
| Resistor 86 | 4.7K |
| Resistor 88 | 4.7K |
| Resistor 92 | 10K |
| Resistor 96 | 10K |
| Resistor 110 | 10K |
| Resistor 114 | 10K |
| Resistor 118 | 10K |
| Resistor 122 | 10K |
| Resistor 132 | 3.3K |
| Resistor 136 | 3.3K |
| Resistor 140 | 3.3K |
| Resistor 148 | 1K |
| Resistor 154 | 33K |
| Resistor 156 | 5.6K |
| Resistor 162 | 10K |
| Resistor 164 | 18K |
| Resistor 166 | 3.3K |
| Potentiometer 84 | 10K |
| Potentiometer 90 | 10K |
| Potentiometer 100 | 100K |
| Potentiometer 101 | 100K |
| Potentiometer 102 | 100K |
| Potentiometer 103 | 100K |
| Potentiometer 124 | 10K |
| Potentiometer 126 | 10K |
| Potentiometer 128 | 10K |
| Potentiometer 130 | 10K |
| Potentiometer 160 | 10K |
| Capacitor 98 | 1 μf |
| Capacitor 104 | .47 μf |
| Capacitor 105 | .47 μf |
| Capacitor 106 | .47 μf |
| Capacitor 107 | .47 μf |

TABLE I-continued

| | |
|---|---|
| Capacitor 142 | .01 μf |
| Capacitor 150 | .47 μf |
| Diode 144 | 1N916B |
| Diode 158 | 1N916B |
| Transistor 138 | 2N3497 |
| Transistor 146 | 2N3506 |
| Comparator 108 | ¼ LM239 |
| Comparator 112 | ¼ LM239 |
| Comparator 116 | ¼ LM239 |
| Comparator 120 | ¼ LM239 |
| Amplifier 80 | ¼ RC4136 |
| Amplifier 94 | ¼ RC4136 |
| Amplifier 134 | ¼ RC4136 |

While several embodiments of the invention, together with modifications thereof, have been described in detail herein and shown in the accompanying drawings, it will be evident that various further modifications are possible without departing from the scope of the invention.

What is claimed is:

1. A function generator, comprising in combination:

a primary differential amplifier having first and second input terminals and a feedback loop from an output terminal to the second of the input terminals;

a first gain resistor also connected to the second input terminal and to a reference potential;

a plurality of additional gain resistors interconnected to the second of the input terminals;

a voltage ladder network providing control voltages in number equal to the plurality of additional gain resistors; and a plurality of secondary differential amplifiers equal in number to said additional gain resistors individually connected to one of said resistors and one of the control voltages to vary the gain of said primary differential amplifier.

2. A function generator as set forth in claim 1 wherein each of the secondary differential amplifiers includes first and second input terminals and a feedback loop from an output terminal to the second of the input terminals.

3. A function generator as set forth in claim 1 wherein said voltage ladder network generates sequentially higher control voltages to each of the secondary differential amplifiers.

4. A function generator as set forth in claim 3 wherein the control voltages are set at desired breakpoints for the output of said primary differential amplifier.

5. A function generator as set forth in claim 1 wherein said feedback loop includes a feedback resistor connected from the output terminal to the second input terminal.

6. A function generator as set forth in claim 5 wherein the gain of the primary differential amplifier varies with the ratio of the feedback resistor to the gain resistors clamped by conducting secondary differential amplifiers to said voltage ladder network.

7. A function generator as set forth in claim 1 wherein the number of secondary differential amplifiers establishes the breakpoints in the output waveform from said primary differential amplifier.

8. A function generator, comprising in combination:

a primary differential amplifier having first and second input terminals and a feedback resistor connected from the output terminal to the second input terminal;

a first gain resistor also connected to the second input terminal and to a reference potential;

a plurality of additional gain resistors interconnected to the second of the input terminals;

a voltage ladder network providing control voltages at desired breakpoints in the output of said primary differential amplifier and in number equal to the plurality of additional gain resistors; and a plurality of secondary differential amplifiers equal in number to said additional gain resistors to individually connect one of said resistors to one of the control voltages to vary the gain of said primary differential amplifier in accordance with the ratio of the feedback resistor to the gain resistors clamped by conducting secondary differential amplifiers to said voltage ladder network.

* * * * *